United States Patent [19]

Albertini

[11] Patent Number: 4,914,880

[45] Date of Patent: Apr. 10, 1990

[54] INTERNAL PARTITION WALL FOR MASONRY STRUCTURES

[75] Inventor: Alberto Albertini, Traversetolo, Italy

[73] Assignee: Coopsette S.C.R.L., Castelnovo Sotto, Italy

[21] Appl. No.: 220,525

[22] Filed: Jul. 18, 1988

[30] Foreign Application Priority Data

Aug. 6, 1987 [IT] Italy ..... 21595

[51] Int. Cl.[4] ..... E04H 1/00; E04B 2/82

[52] U.S. Cl. ..... 52/243; 52/126.4; 52/238.1; 52/241

[58] Field of Search ..... 52/238.1, 241, 243, 52/126.3, 126.4

[56] References Cited

U.S. PATENT DOCUMENTS

| | | | |
|---|---|---|---|
| 1,420,473 | 6/1922 | Dawson et al. | 52/243 |
| 3,034,609 | 5/1962 | Young | 52/241 |
| 3,078,968 | 2/1963 | Frick | 52/241 |
| 3,124,222 | 3/1964 | Mote | 52/515 |
| 3,189,140 | 6/1965 | Luss | 52/36 |
| 3,261,625 | 7/1966 | Cripe | 52/239 |
| 3,312,021 | 4/1967 | Rolland | 52/126.3 |
| 3,371,454 | 3/1968 | Anderson | 52/126.4 |
| 3,451,183 | 6/1969 | Lespagnol et al. | 52/241 |
| 3,550,338 | 12/1970 | Satkin et al. | 52/241 |
| 3,694,975 | 10/1972 | Pollock | 52/36 |
| 4,027,444 | 6/1977 | Berg | 52/243 |
| 4,057,123 | 11/1977 | Erickson | 52/239 |
| 4,065,898 | 1/1978 | Munk | 52/404 |
| 4,395,856 | 8/1983 | Smith et al. | 52/239 |
| 4,535,577 | 8/1985 | Tenser et al. | 52/242 |

FOREIGN PATENT DOCUMENTS

| | | | |
|---|---|---|---|
| 2238020 | 2/1975 | France | 52/126.4 |
| 2501750 | 9/1982 | France | 52/238.1 |
| 2546209 | 11/1984 | France | 52/238.1 |
| 103699 | 4/1964 | Norway | 52/243 |

*Primary Examiner*—Michael Safavi

*Attorney, Agent, or Firm*—Herbert Dubno; Andrew Wilford

[57] ABSTRACT

A partition wall, preferably, a fire retardant partition wall, has posts and crossbars consisting of steel hollow profiles with grooves on the broad and narrow sides. A narrow groove on the board side serves to receive elastic couplings attaching the crossbars to the posts. A wide groove extending the full width of each wide side receives a sealing strip baring on panels which are suspended from studs traversing the posts. Between the panels on opposite sides of the structure, a thermally insulating nonflammable material is received and a labyrinth seal can be provided between the panels and the posts and crossbars and between the packing material and these hollow profiles.

14 Claims, 5 Drawing Sheets

INTERNAL PARTITION WALL FOR MASONRY STRUCTURES

FIELD OF THE INVENTION

My present invention relates to a partition wall with fire/shielding properties which is designed to be erected within a masonry structure. More particularly, the invention relates to an internal sectional partition, and can have windows, doors and fire-blocking portions and which is capable of being used in a structure for dividing larger spaces.

BACKGROUND OF THE INVENTION

The use of internal partitions within a masonry structure for use in subdividing the available space is common in office construction and the like, for example to create a number of smaller offices or smaller spaces with specific uses, etc.

Such internal partition walls can have a composite structure to allow them to be maintained in place where desired as soon as the masonry of the building is completed and, of course, should be designed to allow rapid setup and facilitate changing the internal space division.

Walls of this type may be designed to present very specific characteristics. For example, they should be able to provide efficient sound insulation and to act as shields against the incursion of dust to a particular space. They should be able to accommodate doors and transparent elements forming windows and should be constructed to be able to support shelves, cabinets, or the like which may be suspended or attached to such walls.

It is also important that the particular wall be fire-resistant or fire-retardant, i.e. capable of maintaining the structural integrity of the wall to separate a space containing a flame or fire from a space which may be protected for a certain period of time against the penetration through the wall by the fire or the transmission of fire through the wall to the protected space. The wall should also shield the protected space from the incursion of smoke at least for a limited time. This, of course, is intended to safeguard the occupants of the protected space and give the occupants an opportunity to be rescued or to save themselves.

There are, of course, standards which may also have to be met with respect to such walls and a variety of desiderata which establish other requirements for them. Already mentioned is the importance of acoustic insulation so that the spaces separated by the partition wall can in fact be private and, in the case where noise of a dangerous level is generated in one of the spaces, the other space must be protected thereagainst.

It is also advantageous to enable the partition wall to act as a moisture barrier, to provide the partition wall so that it affords protection against radiation, to have the partition wall resist mechanical perforation or penetration of the wall structure, etc.

Partition walls have been proposed heretofore in which the carrying elements of the panels are composed of light alloys, for example, aluminum or its alloys. These light alloys fail even when very high temperatures are not reached so that partitions composed of such materials, when subjected to fire, collapse early in the development of this dangerous condition. In most instances, there is no insulation providing protection against fire and smoke.

It has been recognized that such partitions are not very effective in such fire conditions and thus there have also been proposed steel structures which are not aesthetic and do not lend themselves to assembly in various partitions so that partitioning made from such materials is not versatile. It has also been suggested that, apart from meeting aesthetic requirements, the partition wall must be easily and rapidly assembled with the least amount of equipment and manpower, and must be adjustable to the dimensions of the space which must be subdivided.

These requirements are also not satisfactorily met by prior art partition walls.

OBJECTS OF THE INVENTION

It is, therefore, the principal object of the present invention to provide an improved partition wall which satisfies the desiderata enumerated above, is free from the drawbacks of earlier partition walls and which is of comparatively low cost.

An object of my invention is to provide a partition which can be easily assembled, disassembled and moved but which, nevertheless, is aesthetically pleasing in appearance and has a high degree of resistance to fire, while blocking penetration of smoke between two spaces separated by the partition wall.

Yet another object of the invention is to provide a cost effective partition which is easy to setup and move and which can be easily adjusted to suit the space requirements for the partition in a masonry structure.

SUMMARY OF THE INVENTION

These objects are attained, in accordance with the invention, in an internal partition wall for a masonry structure having a ceiling, a floor and masonry walls extending between the ceiling and the floor. The internal partition wall can comprise perimetral steel profile members affixed to the ceiling, the floor and the masonry walls to define a generally rectangular perimetral frame; a plurality of horizontally spaced vertical steel posts secured to profile members affixed to the ceiling and the floor, each of the posts being provided on opposite sides of the respective post with respective locking elements; a plurality of horizontal steel crossbars of substantially the same width as the posts secured between pairs of the posts and defining a partition-support skeleton of a grid pattern therewith; means composed of steel for interlocking the crossbars with the posts; panels mounted on the locking elements panels on opposite sides of the partition-support skeleton defining between them an internal space having a thickness equal to the widths of the posts and the crossbars, the posts and the crossbars having configurations providing sealing locations between neighboring edges of adjoining panels; sealing elements secured to the posts and crossbars at the locations and sealingly engaging the panels to substantially seal the space; and a nonflammable packing of low thermal conductivity filling the internal space between the panels and, together with the posts, the panels, the sealing elements and the members, effectively separating external spaces on opposite sides of the partition wall against penetration through the wall of a damaging factor acting in one of the external spaces, while providing locations for cables and utility lines.

According to a feature of the invention, the posts and crossbars are tubular profiles folded and seamed from a steel sheet and having at opposite sides turned toward said panels identical undercut wide grooves defined between outwardly convergent flanks and, at opposite sides at right angles to the opposite sides having the wide grooves, having undercut narrow grooves defined between outwardly convergent flanks, the sealing elements being strips received in said wide grooves, the means composed of steel for interlocking the crossbars with the posts including elastic elements received in ends of said crossbars and secured thereto, the elastic elements being engaged in the narrow grooves.

More specifically, the tubular profiles are of generally rectangular cross section with wide sides and narrow sides, the narrow grooves being formed in the wide sides generally centrally therein, the wide grooves extending substantially the full widths of the narrow sides.

The tubular profiles of the post, more particularly, can have planar portions of the wide faces adjoining the respective narrow grooves, the locking elements including studs inserted in the planar portions and projecting therefrom to support the panels, the posts being attached to the members affixed to the ceiling and the floor by additional studs inserted in the planar portions and projecting therefrom.

It will be apparent, therefore, that the composite internal partition wall of the invention has a plurality of posts and crossbars affixed to one another to form a grid, frame or like support structure within perimetral metal profiles which are affixed to the masonry structure and can be made a part thereof.

The term "profiles" is used herein to refer to a structural shape which may have a thin wall by comparison to the load-bearing section of the structural shape and, of course, which is preferably of the configuration previously described.

Opposite faces of the frame structure formed by posts carry panels which define between them an internal air space of a thickness equal to the width of the posts and by bars.

The sealing elements between the crossbars and posts are made of steel according to the invention and are of a configuration that they permit sealing strips, shielding elements and like structures to form tongue-and-groove joints with the posts and crossbars. The internal air space between the panels on opposite sides of this support structure can be filled with thermally nonconductive and nonflammable metals. The panels and the sealing strips are designed so that there is an effective separation of one face of the wall, which may be subjected to a damaging agency, such as fire, from the other face. The partition wall is also provided with locations in which cables and connection lines for auxiliary equipment hereinafter referred to as utility lines can be received.

Within undercut grooves having flanks which converge outwardly, the aforementioned ceiling strips can be accommodated and thus grooves may also receive elastic elements fitted in the ends of the crossbars and insertable into the aforementioned grooves of the posts.

When the tubular profile of the posts and crossbars, which can be of the same cross sectional shape, is generally rectangular and has two relatively wide faces opposite to one another and adjoining relatively narrowed faces, one such groove is provided over a fraction of each wide face and is located centrally thereof. These grooves, located in a median plane through the tubular profile can be referred to as relatively narrow grooves by comparison with the wide grooves which extend over the entire width of the narrow faces.

The narrow grooves of the wider faces and the wide grooves of the narrow faces all have outwardly convergent flanks to form the undercut portions of the respective grooves.

The narrow grooves of the wider faces are adapted to receive friction means for affixing the crossbars to the parts and shielding or insulation means, while the wider grooves of the smaller faces are shaped to receive the sealing strips, if desired, and profiles for the mounting of exterior fixtures such as shelves and cabinets.

The major faces of the tubular profiles, i.e. the face formed with the narrow notches, have planar portions adjoining the narrow notches which are traversed by studs for securing the posts to the perimetral profile or form members and bolts or pins upon which the panels of the walls are supported. The latter can be formed with hooks engaging the pins, bolts or studs.

The profiles of the posts and crossbars have frontal surfaces or sides, i.e. the sides which are parallel to and partly overlain by the panels, which have grooves of the width equal to the width of these faces and defined by flanks of reduced thickness so that these sides are largely recessed inwardly from the exterior so that flat bottoms of the grooves are spaced inwardly from the panels, delaying thermal conduction between panels on one side and the posts or crossbars and, therefore, also between the panels on opposite sides of the support structure.

The elastic means affixing the crossbars to the posts by friction comprise couplings which are secured to the ends of the crossbars and which can be fitted into the ends of these tubular members. Advantageously, these couplings have elastic fork-shaped protrusions with vertical lateral flanks inclined to the axis of the crossbar at an angle which corresponds to the angle of inclination of the flanks of the narrow grooves in which these couplings are to be frictionally received. The thicknesses of the couplings should be less than the widths of these narrow grooves.

Consequently, the couplings can be inserted into the narrow grooves and, by rotation of the crossbars through 90°, can be set in place so that the elastic forks lie horizontally. Of course, the forks are inserted into the narrow grooves with a vertical orientation, i.e. an orientation 90° offset from their final positions. The elastic spreading action of the forks should be sufficient to elastically retain the crossbars in position on the posts by friction.

The panels may consist of planar elements of rigid material which can be fire resistant or retardant and can have a finished surface or a surface otherwise selected to satisfy aesthetic requirements. The inner surface of the panels can be provided with hooks as desired for engagement with studs projecting from the larger sides of the posts.

The fire shielding means which forms a labyrinth seal preventing ready passage of flame and smoke from one side of the partition to the other may be constituted, in this embodiment, by a steel sheet which engages in a tongue-and-groove joint with the grooves of the posts and crossbars and extending orthogonally with respect to the traverse faces of the post and crossbar profiles into the nonconductive material filling the space between the panels on opposite sides of the structure.

The panels, moreover, are preferably provided with intumescent seals along their peripheral edges which expand upon heating and close off the gaps between them and hence contribute to blockage of flame and smoke penetration in case of fire. As an alternative or, in addition, seals can be provided between the posts and crossbars and the panels, the seals being composed of a material resistant to high temperature.

According to yet another embodiment of the invention, the panels themselves may be made of metal sheet and can form labyrinth structures engaging in or defining with the grooves the support structure and a seal preventing direct passage of flame and smoke from one side of the wall to the other.

In the spaces comprised between opposite panels of the wall as well as within the perimetral profile members passages can be provided for electrical power and communication cables for supplying equipment positioned to one side or the other of the wall or mounted upon the wall. Appropriate elements for connection to such cable may be mounted on the walls, and openings, for example passages, can be provided in the panels, posts or crossbars.

BRIEF DESCRIPTION OF THE DRAWING

The above objects, features and advantages of my invention will become more readily apparent from the following description, reference being made to the accompanying drawing in which.

SPECIFIC DESCRIPTION

Figure 1:
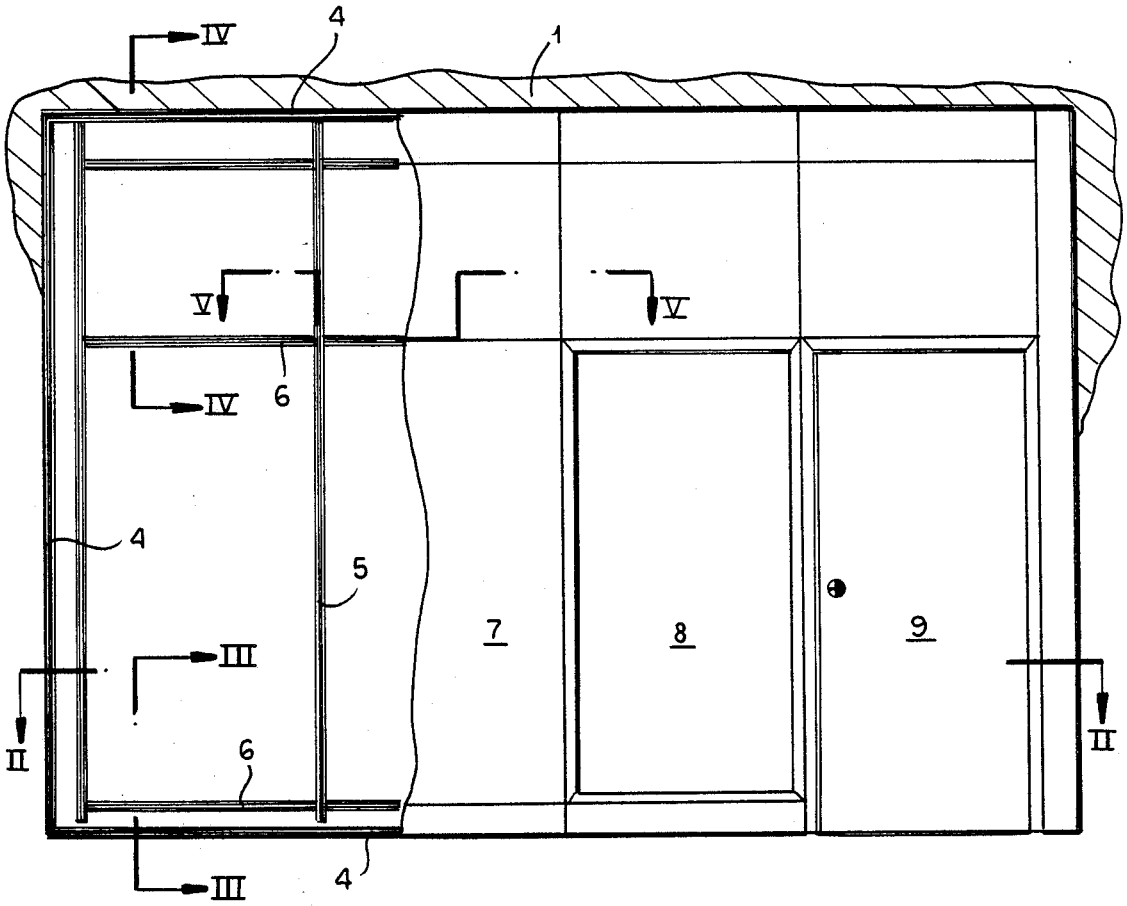
FIG. 1 is an elevational view of a partition according to the invention seen in section through the masonry structure and partly broken away, illustrating a partition wall according to the invention.
Figure 2:
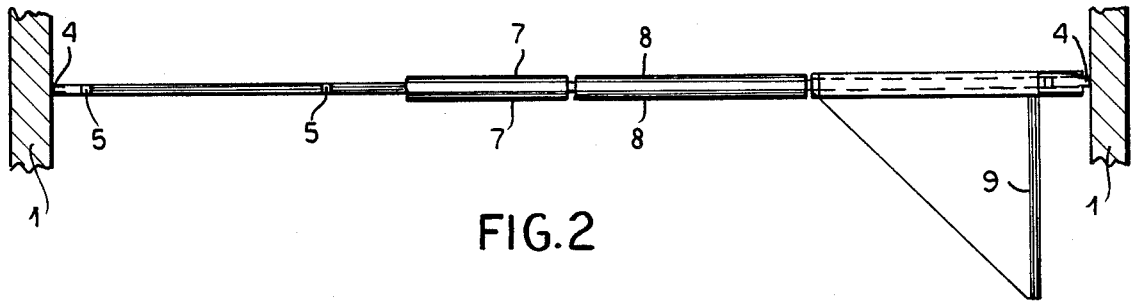
FIG. 2 is a section taken generally along the line II—II of FIG. 1.

The partition wall as shown in FIGS. 1 and 2 is bridged between a pair of walls 1, a floor and a ceiling 3 of masonry construction to define within a structure or a room with very large dimensions two smaller spaces located on opposite side of the partition wall.

The partition wall basically comprises a perimetral form 4 which may be secured to the walls 1, the floor 2 and the ceiling 3, e.g. by studs, anchor bolts or cementing. The floor and ceiling members of the frame 4 have the posts 5 connected to them and the crossbars 6 spanned between the posts and the vertical members of the frame 4. The posts 5 and crossbars 6, therefore, define a support structure which has a grid configuration and can, therefore, have receptacles of different dimensions which are covered by panels 7 of corresponding shape. The panels 7 which can be referred to as buffer panels, are generally opaque. Some of the receptacles can receive optically transparent elements or windows 8 while others can have doors 9 hingedly mounted to the posts 5 defining them.

The panels 7, if fire-resistant or fire-retardant, can make the entire partition wall fire resistant and can cause the partition wall to comply with standards for retarding fire transmission between the spaces separated by the partition wall and, in addition, can prevent passage of smoke from one side to the other.

Figure 3:
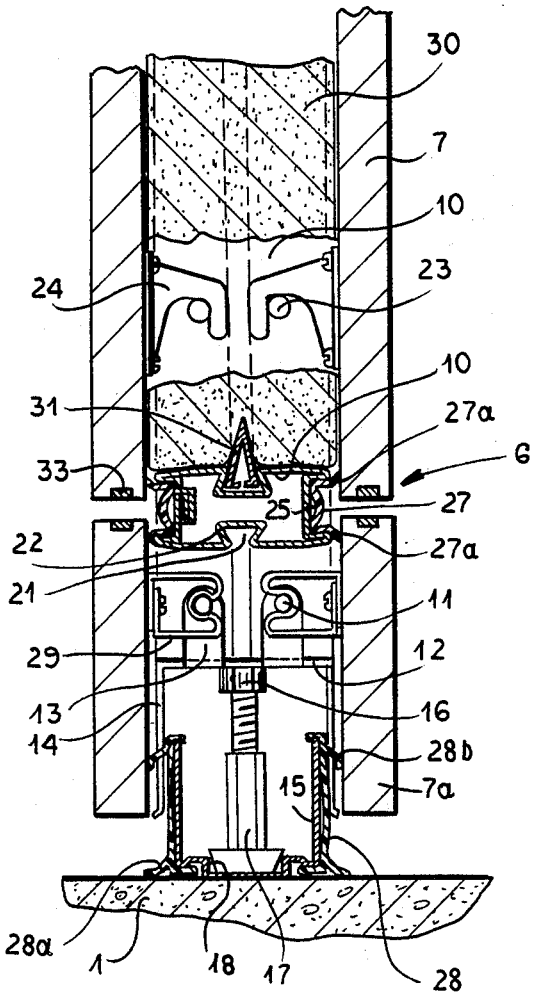
FIG. 3 is a section taken generally along the line III—III of FIG. 1.

To enhance the fire protective effect as shown in FIGS. 3–6, the posts 5 of the wall structure comprise steel profiles made of folded steel sheet in a tubular shape and provided with a seam where the edges of the folded sheet are joined together. A conventional weld-seam can be used for this purpose, but I prefer to use a technique whereby the edges are folded together two or three times as shown in FIG. 3.

Figure 4:
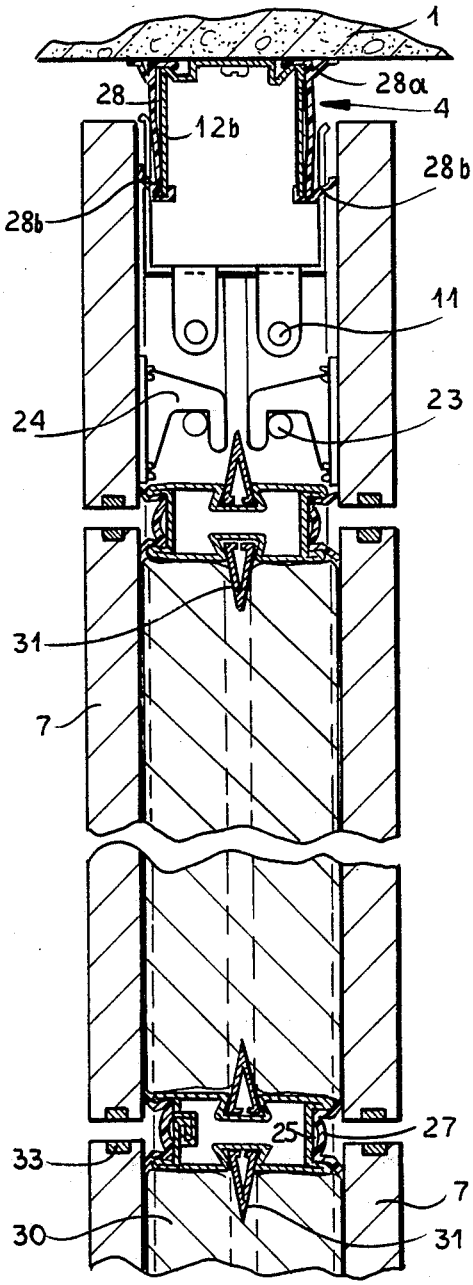
FIG. 4 is in section taken generally along the line IV—IV of FIG. 1

At their ends, the posts 5 are secured by studs 11 to respective U-brackets **12*a* that are each provided with lugs 13 traversed by the studs 11 and have legs 14 which can fit over the frame members (see FIGS. 3 and 4, for example). In FIG. 3, the lower frame member has been represented at 15**.

As can also be seen from FIG. 3, the lower U-brackets **12*a* are each provided with a threaded element 16, e.g. a nut welded to the U-bracket, in which a threaded bolt 17 is inserted. The thrust bolt 17 has a head received in the groove 18 of the profile member 15 and can be rotated to adjust the height of the post 5**.

The crossbars 6 are tubular elements of the same profile as the posts 5 and are connected thereto by means of couplings 19 which can be elastic as will be described in connection with FIGS. 7 and 8. The couplings 19 can be comprised of sintered iron or steel and are connected by pins, rivets, U-bolts in the ends of the crossbars 6, the couplings 19 have a fork-shape with portions 20 which elastically are compressed inwardly and thus bear outwardly against the flanks of the grooves 21 which are undercut as can be seen at 22 in FIG. 3.

In this manner, the crossbars can be affixed at desired heights to the posts and will remain locked in position by friction. The crossbars generally are not subjected to any load except their own weight and serve to brace the post structure horizontally.

Figure 7:
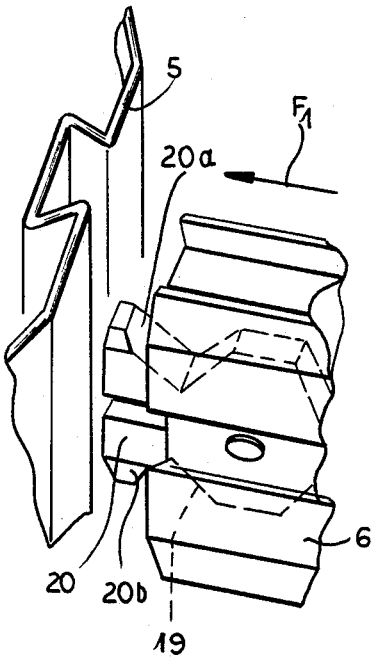
FIG. 7 is a perspective exploded view diagrammatically illustrating the connection between the fragment of the post which is shown to the fragment of the crossbar.
Figure 8:
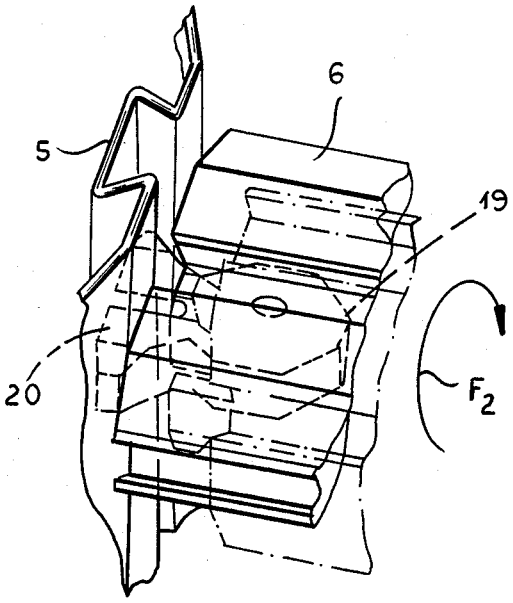
FIG. 8 is a fragmentary perspective view illustrating the final stage in the connection.

As can be seen from FIGS. 7 and 8, the assembly of the crossbars 6 to the posts 5 can be carried out very quickly. The fork portions 20 of the couplings 19, previously secured to a crossbar 6, can be inserted into the respective groove 21 with the couplings 19 oriented at 90° to the final orientation. The insertion is represented by the arrow $F_{11}$ in FIG. 7. Then the crossbar is rotated as represented by the arrow $F_2$ in FIG. 8 through 90° to cause the inclined flanks **20*a* of the fork partition 20 to engage the undercut flanks 22** of the groove, therefore, compressing the fork as the crossbar and couplings are brought into their final positions.

Because the portions 20 are elastically stressed, the intrinsic outward bias generates a friction force between the flanks **20*a* and 20*b*** which is the blocking force maintaining the end of each crossbar against the posts and the flanks in frictional engagement to ensure the rigidity of the structure.

The profiles 10 of the posts 5 also have additional studs 23 projecting transversely from one or both sides and onto which hooks, 24 of the opaque buffer panels 7 can engage.

On the sides of the profiles 10 adjoining the wide sides, i.e. on the narrow sides of the posts and crossbars, outwardly open grooves 25 (FIG. 6) can be provided, these grooves being defined between inclined flanks 26 so that they are effectively undercut.

Figure 5:
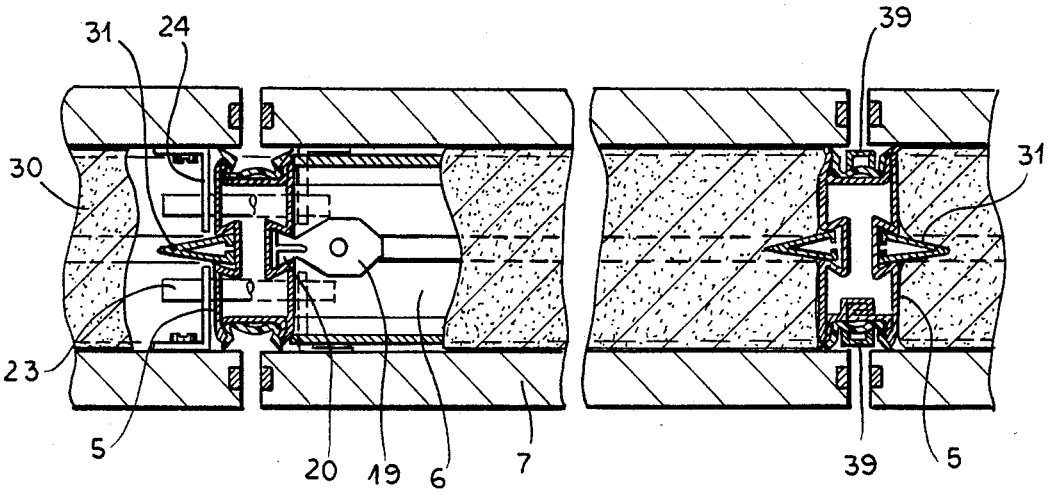
FIG. 5 is a section taken along the line V—V of FIG. 1.

As can be seen from FIGS. 4 and 5, moreover, within the grooves 25, packing strips or profiles 27 can be received, the packing strips 27 having legs 27*a* (FIG. 3 or FIG. 6) which are capable of pressing against the inner surfaces of the panels (see FIG. 3 or FIG. 4). Each strip 27, therefore, can press against inner surfaces of two proximal panels on the respective side of the support structure, thereby sealing the wall against the penetration of dust and noise.

Sealing is also ensured against the profiles 15 of the perimetral frame via packings or gaskets 28 best seen in FIGS. 3 and 4.

The gaskets 28 have flexible legs 28*a* which can press against the floor or ceiling and flexible legs 28*b* which seal against the inner surfaces of the buffer panels 7 proximal to the ceiling and floor, respectively.

Along the lower part of the wall, a base panel which can be ornamental in design can be provided as shown at 7*a* and can have spring hooks 29 adapted to snap onto the stud 11 of the U-brackets 12 (see FIG. 3). The base panels may be mounted independently of the other panels of the wall, thereby allowing access to the threaded studs 17, or to final assembly of the panels 7*a* onto the wall allowing a fine adjustment of the heights of the posts and making it possible to adjust or align the edges of the panels. During such adjustment, the upper U-brackets 12*b* can slide into the upper profiles 15 of the perimetral form, permitting the vertical adjustment and compensating for possible defects in the horizontal lie of the ceiling and possible undulations therein.

Since all of the elements connected to the masonry are made of steel, they are not subject to loss of supporting strength except at very high temperatures and indeed, temperatures considerably higher than those to which light alloy elements can be exposed.

In addition, between the panels on opposite sides of the wall, the thermally insulating and nonflammable material 30, such as mineral wool, can be packed.

The grooves 21 can also receive fire-proof or fire-retardent profiles 31 which are made of steel and can spring or snap into place (see FIGS. 3 and 4) so that a labyrinth-type of impediment is provided for the transmission of fire and smoke from one side of the wall to the next. This can delay transmission of fire from one space to the other separated by the wall.

In fact, the mineral wool 30 provides thermal insulation between the panels 7 on the two faces of the wall while the direct passage of the flames from one face of the wool to the other in contact zones between the mineral wall 30 and the profiles 10 of the posts 5 and the crossbars 6 is impeded or prevented by the fact that the steel profiles 31 penetrate into the mineral wall to form the aforementioned labyrinth seal.

The grooves 25, moreover, also contribute to fire-blocking effects of the structure, since the floor of these grooves is set back from the panels and thus space the flame front represented by the panel surfaces from the main heat transmitting parts of the posts and crossbars.

Figures 6, 12:
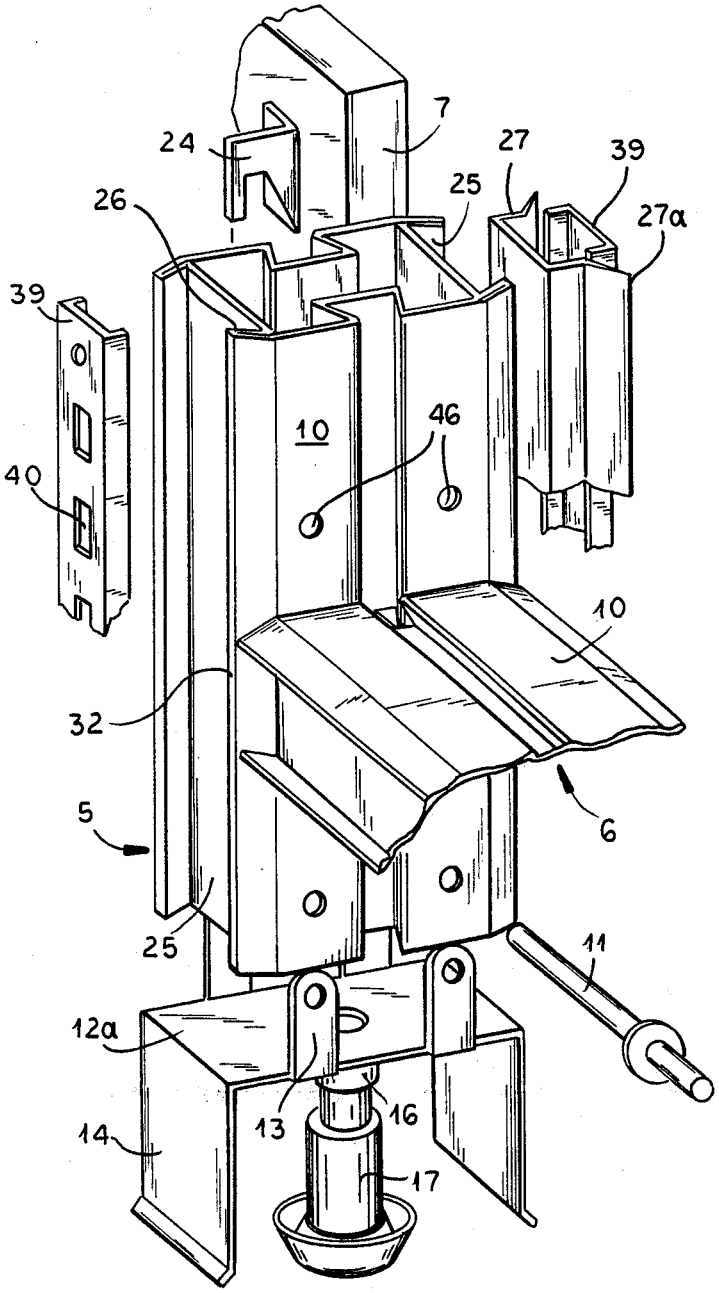
FIG. 6 is an exploded view illustrating an assembly of a post and crossbar and showing the means for attaching the bottom of the post to a profile member extending along the floor of the building.
FIG. 12 is a fragmentary perspective view illustrating the suspension assembly.

Only a thin strip 32 is, therefore, exposed to fire to serve as a heat transmitter (see FIG. 6).

Even though the profiles of the posts and crossbars, therefore, are of heat conductive material, the rate of heat transmission from one side of the partition to the other generally will be slow.

In order to avoid passage of smoke and noxious fumes through the wall in the case of fire, especially when the sealing strips 27 are made of synthetic resin material which may eventually degrade under the effect of fire so that they can no longer perform their sealing function, the edges of the panels are provided with intumescent seals or gaskets 33 which can expand or swell with increasing temperature to seal the gaps between adjacent panels.

When the sealing profiles are made of ceramic fiber or self-extinguishing materials capable of effectively resisting fire for a considerable time, the use of intumescent seals or gaskets can be avoided.

Figure 9:
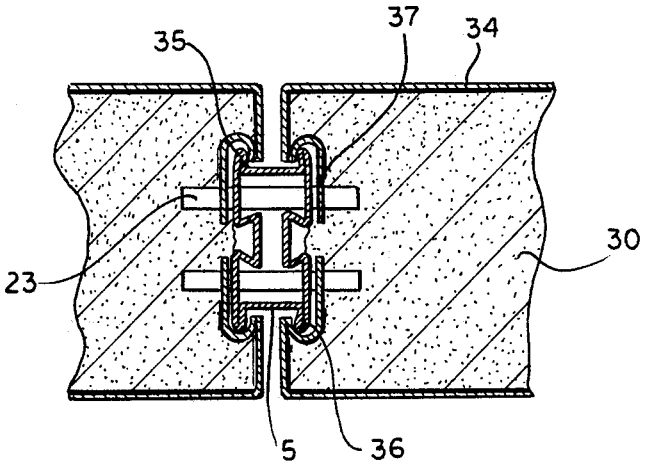
FIG. 9 is a detailed section of another embodiment of the panel structure.

As has been illustrated in FIG. 9, a steel sheet 34 can have a member forming a groove 35 capable of receiving a gasket 36 of cylindrical cross-section which can press against the edge or strip 32 of the posts and crossbars. From this gasket seat, the steel sheet extends with a planar flange 37 which can be notched to form the hooks which hang the panels on the studs 23. The members 37 also can penetrate into the nonflammable and thermally insulating material to contribute to the labyrinth seal.

The elastic deformation of the members 36 can cushion the panels against the edges 32 so that the mounting is vibration free.

Since the flanges 37 are provided to form the labyrinth seal, the profiles 31 can be omitted.

The sheet 34 can be coated, varnished or otherwise treated to suit the desired aesthetics of the partition and can so resemble the panels 7 previously described so that there is no aesthetic discontinuity between the panels 7 and the panels provided with the metal sheets 34.

It has been found to be advantageous, moreover, to mount within the grooves 25 of the posts 5 crossbars or the like, channels 39 provided with spaced apart slots 40 as can be seen in FIG. 6 for receiving shelf brackets or the like. This makes it possible to affix to the posts, via brackets 42, a variety of accessories, such as cabinets or the like as represented at 41, in desired positions, without having to specially drill holes for this purpose.

For permanent adjustment of the positions of such accessories at any time, the channels 39 may be mounted in the grooves 25 outwardly of the gaskets 27 (see FIG. 6).

Figure 10:
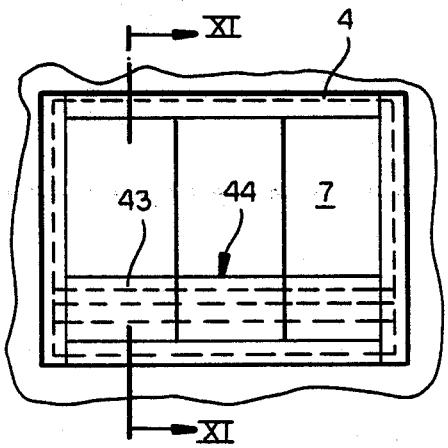
FIG. 10 is a view similar to FIG. 1 on a smaller scale, showing the cables and conductors within the wall.
Figure 11:
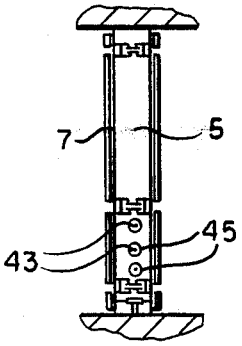
FIG. 11 is a section taken along the line XI—XI of FIG. 10.

Between the panels 7, the space can receive cables and connecting lines or devices generally represented at 43 and shown in FIGS. 10 and 11 and which can extend over a lower zone 44 of the wall. Holes 45 are provided in the posts 5 to permit passage of such utility lines. The utility lines may also run in the perimetral frame 4, allowing connection of the lighting fixtures, computers and word processing equipment, telephone lines and the like as may be required.

It has been already mentioned that transparent elements 8 and doors 9 can be mounted in the wall structure and, where fire retardancy is a requirement, these elements should also be of fire resistant or fire-retardant types.

If fire retardancy is not a requirement, then needless to say, the window and door structures need not be fire retardant either.

Naturally, if different types of shielding may be required, for example, shielding against mechanical perforation, a combination of moisture barrier and acoustic insulation or any other combination of features, the sealing strips 27 or the means provided in the grooves 21 can be selected accordingly and, of course, the filling material 30 will also be chosen appropriately.

Where it is not necessary to achieve total protection against fire and where the fire protection need only be partial, the wall can be of different shapes and can extend only over part of the height of the space or can be interrupted vertically or horizontally. Windows, openings and other communications between the spaces on opposite sides of the partition can be provided and any openings can be provided with closing elements of steel or of other materials such as light alloys and the like. The wall can be connected without aesthetic discontinuity to other walls, such as walls with shelves, with furniture such as desks, tables or the like fastened to the wall via the racks 39 or modified in other ways within the spirit and scope in which such units can be connected to the utility lines traversing the wall.

We claim:

1. An internal partition wall for a masonry structure having a ceiling, a floor and masonry walls extending between the ceiling and the floor, said internal partition wall comprising:

perimetral steel profile members affixed to said ceiling, said floor and said masonry walls to define a generally rectangular perimetral frame;

a plurality of horizontally spaced vertical steel posts secured to said profile members affixed to said ceiling and said floor, each of said posts being provided on opposite sides of the respective post with a plurality of respective oppositely outwardly projecting locking studs, each of said posts being formed with undercut narrow grooves defined between outwardly convergent flanks;

a plurality of horizontal steel crossbars of substantially the same width as said posts secured between pairs of said posts and defining a partition-support skeleton of a grid pattern therewith;

interlocking means composed of steel for coupling said crossbars with said posts and including elastic elements operatively connected with respective ends of said crossbars and secured thereto, said elastic elements at each of said ends being insertable into the respective undercut narrow groove of a respective one of said vertical posts;

panels mounted on said locking studs on opposite sides of said partition-support skeleton and defining between themselves an internal space having a thickness equal to the widths of said posts and said crossbars, said posts and said crossbars having configurations providing sealing locations between neighboring edges of adjoining panels;

sealing elements secured to said posts and crossbars at said locations and sealingly engaging said panels to substantially seal said space; and a nonflammable packing of low thermal conductivity filling said internal space between said panels and, together with said posts, said panels, said sealing elements and said members, effectively separating external spaces on opposite sides of said partition wall against penetration through said wall of a damaging factor acting in one of said external spaces, while providing locations for cables and utility lines.

2. The internal partition wall defined in claim 1 wherein the posts and crossbars are tubular profiles folded and seamed from a steel sheet and having at opposite sides turned toward said panels identical undercut wide grooves and, at opposite sides at right angles to the opposite sides, the undercut narrow grooves, the sealing elements being strips received in said wide grooves.

3. The internal partition wall defined in claim 2 wherein said tubular profiles are of generally rectangular cross section with wide sides and narrow sides, the narrow grooves being formed in said wide sides generally centrally therein, said wide grooves extending substantially the full widths of said narrow sides.

4. The internal partition wall defined in claim 3 wherein the tubular profiles of said posts have planar portions of the wide faces adjoining the respective narrow grooves, said studs being inserted into said planar portions and projecting therefrom to support said panels, said posts being attached to said members affixed to said ceiling and said floor by additional studs inserted in said planar portions and projecting therefrom.

5. The internal partition wall defined in claim 4 wherein said wide grooves have flat bottoms parallel to the respective panels but spaced inward thereof and extending substantially the full widths of said posts and said crossbars for impeding thermal conduction between said panels and said posts and crossbars and between panels on opposite sides of said structure.

6. The internal partition wall defined in claim 2 wherein said crossbars extend along respective axes and have elastic elements having fork-shaped portions with vertical lateral flanks having inclinations to the axes of the respective crossbars equal to inclinations of the flanks of said narrow grooves, said fork-shaped portions being insertable into said narrow grooves in positions of said elastic elements rotated by 90° with respect to final positions thereof, and being rotatable together with the respective crossbars into said final position, elastic deformation of the fork-shaped portions in contact with said flanks of the narrow grooves being capable of generating sufficient friction to reliably secure each crossbar at arbitrarily selected locations along said posts.

7. The internal partition wall defined in claim 4 wherein said panels are planar elements of rigid fire-resistant material having aesthetically finished outer surfaces and inner surfaces provided with hooks for engaging said support studs.

8. The internal partition wall defined in claim 1, further comprising intumescent seals along perimetral edges of each panel capable of expanding and sealing gaps between the panels on each side of said structure upon exposure to fire.

9. The internal partition wall defined in claim 1 wherein the packing in said internal space and said perimetral members are formed with a plurality of passages for receiving cables and utility lines.

10. The internal partition wall defined in claim 4, further comprising perforated strips received in said wide grooves for receiving brackets supporting a load on said partition wall.

11. The internal partition wall defined in claim 4, further comprising triangular-section elements received in said narrow grooves and penetrating into said nonflammable packing of low thermal conductivity filling said internal space between said panels.

12. The internal partition wall defined in claim 4, further comprising an adjustable-height U-shaped bracket mounting each of said posts on one of said members affixed to said floor.

13. The internal partition wall defined in claim 4, further comprising a U-shaped bracket mounting each of said posts on one of said members affixed to said ceiling.

14. An internal partition wall for a masonry structure having a ceiling, a floor and masonry walls extending between the ceiling and floor, said internal partition wall comprising:

perimetral steel profile members affixed to said ceiling, said floor and said masonry walls to define a generally rectangular perimetral frame;

a plurality of horizontally spaced vertical steel posts secured to said profile members affixed to said ceiling and said floor, each of said posts being provided on opposite sides of the respective post with respective outwardly projecting locking studs, each of said posts having opposite ends each formed with a respective leg slidably connected to the respective profile members affixed to the ceiling and to the floor;

a plurality of horizontal steel crossbars of substantially the same width as said posts secured between pairs of said posts and defining a partition-support skeleton of a grid pattern therewith;

means composed of steel for interlocking said crossbars with said posts;

panels mounted on said locking studs on opposite sides of said partition-support skeleton defining between them an internal space having a thickness equal to the widths of said posts and said crossbars, said posts and said crossbars having configurations providing sealing locations between neighboring edges of adjoining panels;

first flexible sealing elements secured to said posts and crossbars at said locations and sealingly engaging said panels to substantially seal said space;

means for a fine adjustment of the heights of said posts, said means being connected with the respective legs, said profile members and the respective legs defining other internal spaces therebetween, said other spaces each being sealed with a respective other flexible sealing element extending toward and bearing against the floor and the ceiling, said other flexible sealing elements being in continuous contact with the panels proximal to the ceiling and to said floor; and a nonflammable packing of low thermal conductivity filling said internal space between said panels and, together with said posts, said panels, said sealing elements, said other flexible sealing elements and said members, effectively separating external spaces on opposite sides of said partition wall against penetration through said wall of a damaging factor acting in one of said external spaces while providing locations for cables and utilities.

* * * * *